US005630464A

United States Patent [19]

Bauman et al.

[11] Patent Number: 5,630,464

[45] Date of Patent: May 20, 1997

[54] COLD CHAMBER MAGNESIUM PUMP ASSEMBLY

[75] Inventors: Robert Bauman; Frank Wilson, both of Sparta; Lynn Robb, Steeleville, all of Ill.

[73] Assignee: Spartan Light Metal Products, Inc., Sparta, Ill.

[21] Appl. No.: 552,604

[22] Filed: Nov. 3, 1995

[51] Int. Cl.[6] ..... B22D 17/08; B22D 17/30; B22D 39/00

[52] U.S. Cl. ..... 164/337; 164/312; 222/595

[58] Field of Search ..... 164/133, 337, 164/312; 417/118; 222/593, 603, 629, 595; 266/236, 239

[56] References Cited

U.S. PATENT DOCUMENTS

| | | | |
|---|---|---|---|
| 274,104 | 3/1883 | Ayres | 417/118 |
| 350,761 | 10/1886 | Neff | 417/118 |
| 1,689,698 | 10/1928 | Tornberg | 164/337 |
| 1,736,188 | 11/1929 | Daesen et al. | 417/118 |
| 2,195,360 | 3/1940 | Daesen | 164/337 |
| 2,372,603 | 3/1945 | Pilkington | 266/239 |
| 5,388,633 | 2/1995 | Mercer, II et al. | 164/312 |

FOREIGN PATENT DOCUMENTS

| | | | |
|---|---|---|---|
| 56-81299 | 7/1981 | Japan | 417/118 |

*Primary Examiner*—J. Reed Batten, Jr.
*Attorney, Agent, or Firm*—Polster, Lieder, Woodruff & Lucchesi, L.C.

[57] ABSTRACT

The machine has a holding pot containing molten magnesium in which a pumping chamber is submerged, a filling port is provided through a bottom wall of the pumping chamber, defined at least in part by a cylindrical wall surface, and an axially moveable control rod with a cylindrical shut-off part is moved between a position at which it is within the confines of the cylindrical wall surface and a position at which it is free of that wall surface. The clearance of the cylindrical wall surface and the cylindrical shut-off part of the control rod is such as to permit free movement of the rod part through the port, but, by virtue of the wetting of the surfaces by the molten magnesium, to seal the port against the pressures applied to it. Inert gas, such as argon, is introduced to the pumping chamber when the pumping chamber contains a charge of magnesium and the rod is in a shut-off position, to expel the charge of magnesium, through a runner, to a charging chamber, after which the rod is moved to a position at which the filling port is open to receive molten magnesium from the holding pot to the pumping chamber, the flow of relatively high pressure gas being cut off. Preferably, inert gas under relatively low pressure is provided continuously, which does not prevent the filling of the pump chamber or the expelling of the magnesium from the pump chamber, but does not only facilitate the movement of the molten magnesium through the runner, but maintains an atmosphere of inert gas within the pump chamber, and runner, and facilitates the movement of the molten magnesium through the runner pipe.

5 Claims, 2 Drawing Sheets

COLD CHAMBER MAGNESIUM PUMP ASSEMBLY

BACKGROUND OF THE INVENTION

This invention relates to the pumping of molten magnesium from a pump chamber through a runner to a charging chamber from which it is introduced to a mold by a ram.

Graphite centrifugal pumps, with a submerged discharge scroll housing and impeller mounted on a vertical shaft, are commonly used to circulate or transfer molten metal. Because these pumps are expensive and difficult to maintain, numerous other ways of moving the molten metal have been devised and suggested. Electro magnetic pumps have been proposed, and "aspirating" pumps in which inert gas is introduced into a pipe immersed in molten metal (See U.S. Pat. No. 5,397,378).

One of the objects of this invention is to provide a molten magnesium pump that is simple in construction, effective, easy to maintain, and that serves to protect the molten metal from oxidation.

Other objects will become apparent to those skilled in the art in the light of the following description and accompanying drawing.

SUMMARY OF THE INVENTION

In accordance with this invention, generally stated, in a magnesium die casting machine wherein a charge of molten magnesium is delivered to a die charging chamber, the die casting machine includes a furnace with a holding pot containing molten magnesium in which a pumping chamber is submerged, the pumping chamber having a top wall, a side wall, and a bottom wall, a filling port is provided through the bottom wall, the port being defined at least in part by a cylindrical wall surface. A control rod with a shut-off part with an external surface complementary to the cylindrical wall surface of the filling port is mounted for axial movement between a position at which the shut-off part is within the compass of the cylindrical wall surface and a position at which it is clear of that surface. The complementary surfaces of the control rod and filling port are preferably stainless steel and are spaced sufficiently far to permit the rod to move easily into and out of the port, but sufficiently close so that when the walls are wetted by molten magnesium, they form a seal. In the preferred embodiment shown and described, a gas feed pipe surrounds the control rod. The gas feed pipe is sealed to the upper surface of the top wall as by welding, around a control rod passage in a top wall of the pumping chamber. Inert gas, admired to the gas feed pipe, passes between the control rod and the control rod passage. A riser pipe extends from a point near the bottom of the pump chamber to communicate with a runner through which the molten magnesium passes to a charge chamber. In the embodiment shown, the riser pipe extends above the connection to the runner, and is fitted continuously to receive inert gas at a pressure substantially lower than that of the gas by which the charge of magnesium in the pump chamber is expelled.

The upper end of the control rod is connected to a double acting air cylinder, by which it is moved up out of the filling port and down into the filling port.

In operation, the rod is withdrawn from the filling port to permit molten magnesium in the holding pot to fill the pumping chamber to the desired level. During this time, inert gas is supplied to the pumping chamber and through the runner, at a low pressure to ensure an inert atmosphere above the magnesium. The control rod is then moved down to the place at which the shut-off section is within the compass of the cylindrical wall of the filling port, and inert gas under a higher pressure is introduced into the gas feed pipe, which forces the charge of molten magnesium up through the riser and through the runner, which is inclined downwardly toward its outer end from the horizontal. The continued flow of gas in the riser pipe is temporary cut off of the riser and runner that are filled with molten magnesia, but when, at that point, the flow of higher pressure gas through the gas feed pipe is cut off, and the rod lifted, the flow of low pressure gas through the riser pipe tends to facilitate the splicing of the flow of magnesium, adding to the force of gravity to return the magnesium in the riser to the pumping chamber, and the magnesium in the runner, to the charge chamber. The cycle is then repeated.

IN THE DRAWING

DESCRIPTION OF THE PREFERRED EMBODIMENT

Figures 1, 2:
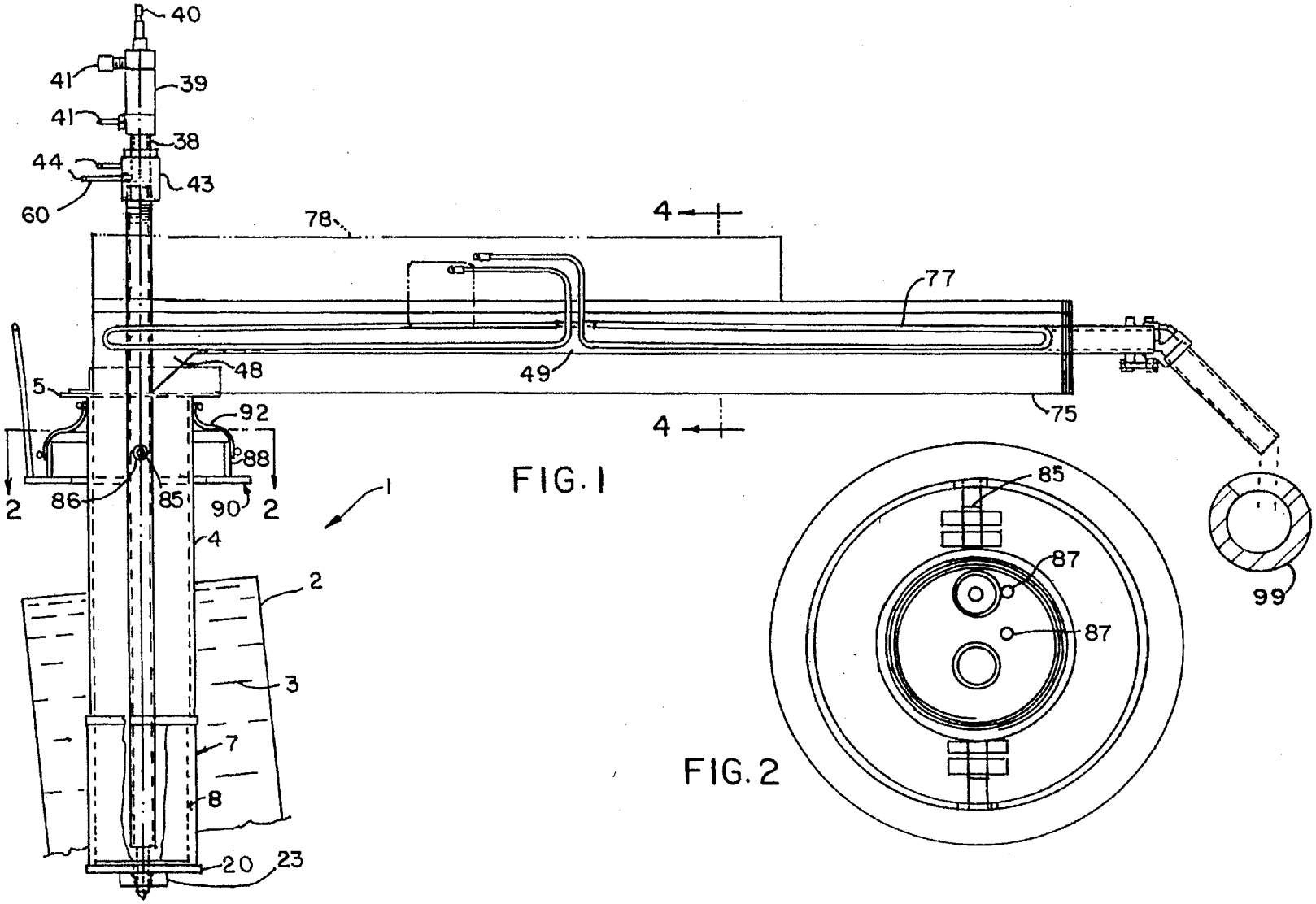
FIG. 1 is a view in side elevation, partly in section, and partly broken away, of one illustrative embodiment of pump assembly of this invention.
FIG. 2 is a sectional view taken along the line 2—2 of FIG. 1.

Referring now to the drawing for one illustrative embodiment of this invention, reference numeral 1 indicates a pump assembly, shown for convenience as lying horizontally and vertically on the page, while a holding pot 2, and molten metal 3 are shown, schematically, as being canted with respect to the pump, whereas, in reality, the pump is canted with respect to the holding pot which is upright.

The pump includes a main body or casing 4, closed at its upper end by a cap plate 5, with, at its lower end, a pump chamber 7. The pump chamber has a side wall 8, a top wall 10 through which a control rod passage 12 and a riser pipe passage 14 extend, and a bottom wall 20. The top and bottom walls are welded or otherwise hermetically sealed to the side wall at their meeting edges.

The cap plate 5 has in it a cap plate gas feed pipe opening 11, coaxial with the control rod opening 12 of the top wall 10, and a cap plate riser pipe passage 18, coaxial with the riser pipe passage 14 of the top wall 10.

The bottom wall 20 has upper surface 21, stepped at its perimeter to form a flange 22, and a lower surface on which a heavy valve plate 23, in this embodiment, is welded. The valve plate 23 forms a part of the bottom wall 20. In this embodiment the valve plate is shown as welded to a lower surface of the bottom wall 20, but it could take the form of a boss integral with the bottom plate. The valve plate 23 has extending through it, a filling port 25, coaxial with the passages 12 and 16, defined by a cylindrical wall surface 26, surmounted by an annular chamfer or countersink 27, which, in ram, is surmounted by a somewhat wider passage 28 through the surface 21 of the bottom wall.

Figure 3:
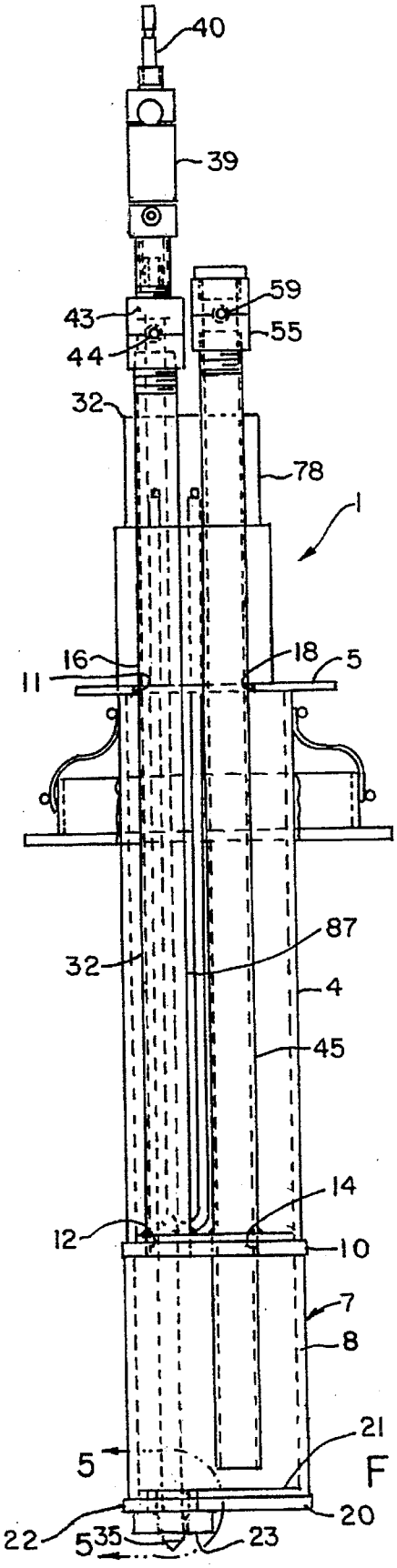
FIG. 3 is an enlarged view in end elevation of the device shorn in FIGS. 1 and 2.
Figure 5:
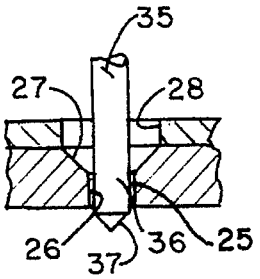
FIG. 5 is an enlarged, fragmentary detail view of a part of FIGS. 1 and 3.
Figure 4:
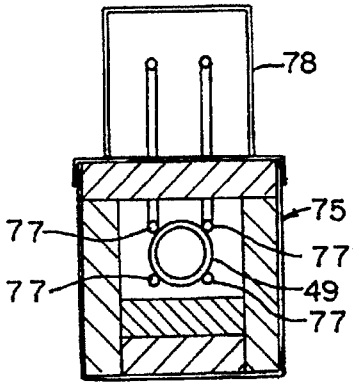
FIG. 4 is a sectional view taken along the line 4—4 of FIG. 1.

A gas feed pipe 32 is welded or otherwise hermetically sealed at a lower end around the perimeter of the passage 12, as shown particularly in FIG. 3. The gas feed pipe extends through the passage 16 in the cap plate 5, and projects a substantial distance above it, as also shown in FIG. 3. A control rod 35 has a shut-off part near its lower end, the extreme end of which is tapered as shown in 37. The shut-off part 36 is shaped complimentarily to the cylindrical wall surface 26 of the valve plate 23. The two surfaces are so dimensioned as to leave a small space, sufficient to permit easy passage of the rod through the filling port, but sufficiently close so that when the surfaces are wetted by molten magnesium, when the shut-off part is within the compass of the cylindrical wall surface, that the magnesium serves as a seal against ingress of the magnesium in the pot and the egress of magnesium from the pump chamber.

At its upper end, the reducer 43 has a pipe nipple 38 threaded into it, upon which a double acting air cylinder 39 is mounted. The air cylinder 39 has a piston 40, to a lower end of which the rod 35 is connected. The cylinder 39 has the usual air line connections 41, leading to a source of compressed air by way of suitable controls, which form no part of this invention.

As has been indicated, the reducer 43 has a passage from an outside surface to its interior, with a fitting 44 to which a gas line is connected leading, in this case, through suitable controls, to a source of argon under pressure.

A riser pipe 45 has a lower end near the upper surface 21 of the bottom wall 20. The riser pipe 45 extends through the riser pipe passage 14, and is welded or otherwise hermetically sealed around its periphery to an upper surface of the top wall 10. At an upper end of the riser pipe 45, a reducer 55, plugged at its upper end, but otherwise the same as the reducer 43 on the gas supply pipe, is threaded. The riser pipe extends through the cap plate riser pipe passage 18. The reducer 55, like the reducer 43, has a transverse passage, with a gas fitting 59 at its outer end, to which an argon line 60 is connected. Above the cap plate 5 and below the reducer 55, the riser pipe connects with and communicates with a runner pipe 49 in a funnel or gusseted connection 48. The runner pipe is enclosed in an insulated housing 75, which contains electric heating elements 77, leads for which end in an electrical junction box. Leads for electrical heating elements 87 in the casing 4, also terminate in the junction box 78, where all of them are connected to suitable sources of electric power.

Below the cap plate 5, the casing 4 has welded or otherwise secured to it minions 85 that rest in trunion journals 86 formed in a collar 88 of a support ring 90. A sock or cowling 92, mounted at a lower end on the collar 88, and at its upper end, around the casing 4, keeps in heat and keeps out foreign matter. The support ring 90 is mounted on a furnace lid. A handle facilitates installing the assembly and rocking the assembly about the trunions to the desired angle.

In operation, the pneumatic cylinder 39 is actuated to move the piston 40 to raise the control rod 35 until it clears the cylindrical wall surface of the filling port, permitting molten magnesium in the holding pot 2 to enter the pumping chamber. Conventional solenoid-operated valves and controls can be used to connect and disconnect the argon supply from the reducers in a pre-programmed cycle, and conventional controls to operate the air cylinder to operate the control rod. Argon is supplied to the riser 45 through the reducer 55, at a relatively low pressure. This does not interfere with the admission of the molten magnesium to the pump chamber, but it does ensure an inert gas atmosphere in the pump chamber. The pneumatic cylinder 39 is then actuated to move the plunger piston 40 down to the place at which the rod assumes the position shown in FIGS. 1 and 3. In this embodiment, the control rod surface and filling port surface are spaced from one another a distance that permits the free movement of the rod in the inlet port, but which causes the molten magnesium to form a liquid seal, sufficient to stop the flow of molten magnesium into the pump chamber and to prevent its flow to the holding pot from the pump chamber when pressure is applied to the contents of the pump chamber. That pressure is applied by introducing argon under the required pressure through the fitting 44 into the gas feed pipe 32, hence, around the rod 35 through the passage 12 in the top wall 10 of the pump chamber. This gas pressure forces the molten magnesium up the riser pipe and through the downwardly slanting runner 49. The flow of gas at relatively low pressure in the runner pipe is interrupted momentarily, but when the charge has been forced from the pump chamber, the gas to the gas feed pipe is cut off, the pneumatic cylinder 39 is actuated to raise the piston 40, and the pressure of the gas in the riser pipe helps to ensure the return of any molten magnesium in the riser to the pump chamber, and to ensure the delivery of any molten magnesium in the runner pipe 49 to a charge chamber 99, shown schematically in FIG. 1, from which it is rammed into the die.

Numerous variations in the construction of the assembly of this invention will occur to those skilled in the art in the light of the foregoing disclosure. Merely by way of example, and not of limitation, the shape of the casing and the pumping chamber can be varied. Although it is by no means the preferred arrangement, the rod shut-off part can be connected to the rod by a thin neck and extend into the holding pot, being pulled up into shut-off position, or a guide tail or spindle can be provided, extending axially downwardly from the shut-off part, to remain within the compass of the cylindrical wall when the rod shut-off part is withdrawn. The rod can be composite, with the shut-off section being of a different material from the rest of the rod, and the boss or plate in which the filling port is formed can also be made of different material from the rest of the bottom wall. The air cylinder that moves the rod can be single acting, with a spring biasing the piston in one direction. A cross connection can be made between the reducer 43 and the reducer 55, to open communication between the gas feed pipe and the riser when and as the supply of gas to the gas feed pipe is cut off, to facilitate the drop in pressure when the higher pressure gas is cut off at the end of the delivery cycle. The angle of taper of the bottom of the control rod complements the angle of the countersink of the filling port to facilitate the entrance of the rod into the filling port, but different angles can be used, as long as they are designed to accomplish the same result. The angle between the casing and runner pipe can be varied from the fight angle shown, to increase the pitch of the runner pipe, for example. In the embodiment shown, the amount of charge in the pumping chamber is regulated by the time the filling port is open, but other means of determining the amount of charge can be used, such, for example, as thermocouple probes. The clearance between the surfaces of the cylindrical wall surface defining the filling port and the shut-off part of the control rod can be varied, depending upon the amount of pressure to be resisted. The higher pressure gas can even be supplied through a separate conduit, through another passage through the top wall of the pump chamber, although the use of the gas feed pipe surrounding the control rod as the conduit for the higher pressure gas is preferred for several reasons. These are merely illustrative.

Having thus described the invention, what is claimed and desired to be secured by Letters Patent is:

1. In a magnesium die casting machine wherein a charge of molten magnesium is delivered to a die charging chamber, the die casting machine including a holding pot containing molten magnesium in which a pumping chamber is submerged, said pumping chamber having bottom, top and side walls, the improvement comprising a filling port through said bottom wall, defined at least in part by a cylindrical wall surface, said pumping chamber being defined by inner surfaces of said bottom, side and top walls, spaced passages in said top wall, one control rod-receiving passage aligned with said filling port and one riser pipe-receiving passage; an axially moveable control rod mounted to extend through said control rod passage, said control rod having a shut-off part with an external surface complementary to said cylindrical wall surface of the filling port, and means for moving said control rod between a position at which said shut-off part is within the confines of the cylindrical wall surface and a position at which said shut-off part is free of said cylindrical wall surface; a riser pipe extending through said riser pipe passage to a point near the inner surface of said bottom wall where it communicates with said pumping chamber, said riser pipe being sealed around its periphery to said top wall and extending to connect and communicate with a runner pipe connected to deliver molten magnesium to said charging chamber; means for delivering inert gas to said pumping chamber, when said chamber contains a charge of molten magnesium, under sufficient pressure to force molten magnesium through said riser pipe and runner pipe when said control rod shut-off part is within the confines of said cylindrical wall surface, the complementary surfaces of said control rod shut-off part and said cylindrical passage being spaced a distance sufficient to permit flee passage of said control rod shut-off part but closely enough to prevent molten magnesium from being forced through the space under the influence of said gas pressure, said molten magnesium wetting the said complementary surfaces to form a seal when the shut-off part is within the confines of said cylindrical passage wall surface.

2. The improvement of claim 1 including means for supplying inert gas continuously to said riser pipe at a low pressure compared with the pressure of gas supplied to force molten magnesium through the riser pipe into the runner pipe.

3. The improvement of claim 2 wherein the means for supplying low pressure gas continuously to said riser pipe include an extension of said riser pipe beyond its connection with said runner pipe, through which said inert gas flows, whereby said gas also flows through said runner pipe when it is not full of molten magnesium.

4. The improvement of claim 1 including a gas feed pipe surrounding said control rod, said gas feed pipe being sealed around a perimetric area around the control rod passage in the top wall of the pumping chamber at a lower end of said gas feed pipe, said control rod passage being of a size to permit the flow of gas between a wall defining the said passage and said rod.

5. The improvement of claim 1 wherein the upper surface of the bottom plate is countersunk around the filling port, and the lower end of the control rod is tapered complimentarily.

* * * * *